US012502040B1

(12) United States Patent
Lovell

(10) Patent No.: US 12,502,040 B1
(45) Date of Patent: Dec. 23, 2025

(54) BATH TOWEL SUSPENSION APPARATUS

(71) Applicant: Laura Jean Lovell, Coatesville, PA (US)

(72) Inventor: Laura Jean Lovell, Coatesville, PA (US)

( * ) Notice: Subject to any disclaimer, the term of this patent is extended or adjusted under 35 U.S.C. 154(b) by 0 days.

(21) Appl. No.: 18/894,260

(22) Filed: Sep. 24, 2024

(51) Int. Cl.

| | |
|---|---|
| ***A47K 10/08*** | (2006.01) |
| ***A47K 10/04*** | (2006.01) |
| *A47G 25/02* | (2006.01) |
| *A47G 25/06* | (2006.01) |
| *D06F 57/12* | (2006.01) |

(52) U.S. Cl.
CPC ..... *A47K 10/08* (2013.01); *A47K 10/04* (2013.01); *A47G 25/02* (2013.01); *A47G 25/0692* (2013.01); *D06F 57/125* (2013.01)

(58) Field of Classification Search
CPC ..... A47K 10/08; A47K 10/10; A47K 10/06; A47K 10/04; A47K 10/025; A47F 5/08; A47F 5/0006; A47F 5/0892; A47G 25/0692; A47G 25/02; A47G 25/0657; D06F 57/125; D06F 57/12; A47B 61/003; A47H 1/02
See application file for complete search history.

(56) References Cited

U.S. PATENT DOCUMENTS 322,330 A * 7/1885 Snow ..... A43D 117/00 211/209
674,673 A * 5/1901 Dauber ..... A47F 5/0892 211/117
1,077,072 A * 10/1913 Hood ..... A47K 10/10 211/16
1,090,837 A * 3/1914 Clarke ..... A47F 5/0892 211/117
1,331,589 A 2/1920 Shoemaker
1,660,940 A * 2/1928 Stein ..... A47K 10/12 4/258
2,139,781 A * 12/1938 Trammell ..... E06B 9/327 160/176.1 R
2,439,238 A * 4/1948 Collins ..... A47K 10/12 248/330.1
4,122,559 A * 10/1978 Kelly ..... A47K 3/38 4/608
5,447,244 A * 9/1995 Mentzer ..... A47K 3/281 4/558

(Continued)

FOREIGN PATENT DOCUMENTS

KR 100978108 B1 * 8/2010 ..... A47K 10/485

*Primary Examiner* — Devin K Barnett

(57) ABSTRACT

The towel suspension apparatus is for use in a shower. The bath towel suspension apparatus mounts from the shower ceiling. The bath towel suspension apparatus is for use with a towel. The bath towel suspension apparatus suspends the towel from the shower ceiling. The bath towel suspension apparatus is an adjustable structure. By adjustable is meant: the elevation of the towel within relative to the shower ceiling adjusts to isolate the towel from the flow of water in the shower space. The bath towel suspension apparatus includes a first belt drive, a second belt drive, a towel rack, and a mounting structure. The mounting structure and the towel rack attach to both the first belt drive and the second belt drive. The towel attaches to the towel rack. The mounting rack suspends the bath towel suspension apparatus in the shower.

8 Claims, 5 Drawing Sheets

(56) References Cited

U.S. PATENT DOCUMENTS

| | | | | |
|---|---|---|---|---|
| 5,749,479 | A * | 5/1998 | Belokin | A47F 5/0892 211/113 |
| 5,979,671 | A * | 11/1999 | Pan | D06F 57/125 211/117 |
| 6,237,781 | B1 * | 5/2001 | Dahl | B62H 3/12 248/320 |
| 7,165,688 | B2 * | 1/2007 | Cameron | A47G 25/02 242/385.1 |
| 7,293,664 | B2 * | 11/2007 | Belokin | A47F 5/0892 211/113 |
| D584,085 | S | 1/2009 | Hendrickson | |
| 8,672,146 | B1 * | 3/2014 | Cole | A47B 61/003 211/85.2 |
| 9,107,495 | B2 * | 8/2015 | Lindo | A47B 57/565 |
| 9,691,304 | B2 * | 6/2017 | Votolato | G09F 7/205 |
| 10,172,451 | B2 * | 1/2019 | Mahugo-Lopez | A47B 43/006 |
| 10,687,619 | B2 * | 6/2020 | Abramov | A47F 7/285 |
| 2006/0051079 | A1 * | 3/2006 | Gerhardinger | F24D 13/022 392/435 |
| 2006/0207952 | A1 * | 9/2006 | Timmons | A47F 5/0892 211/195 |
| 2014/0311995 | A1 * | 10/2014 | Reimer | B65G 1/127 211/49.1 |
| 2015/0014264 | A1 * | 1/2015 | Linnell, Sr. | B62B 3/005 108/147.11 |
| 2015/0320205 | A1 * | 11/2015 | Xue | A47B 55/02 211/41.14 |
| 2017/0367544 | A1 * | 12/2017 | Zellmer | A47K 10/025 |
| 2022/0386824 | A1 * | 12/2022 | Bautista | A47G 25/0628 |
| 2023/0277017 | A1 * | 9/2023 | Hennawi | A47K 10/12 211/105.1 |

* cited by examiner

BATH TOWEL SUSPENSION APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Not Applicable

SUMMARY OF INVENTION

The bath towel suspension apparatus is a storage device. The towel suspension apparatus is adapted for use in a shower space. The bath towel suspension apparatus mounts from the shower ceiling. The bath towel suspension apparatus is adapted for use with a towel. The bath towel suspension apparatus suspends the towel from the shower ceiling. The bath towel suspension apparatus is an adjustable structure. By adjustable is meant that the bath towel suspension apparatus adjusts such that the elevation of the towel relative to the shower ceiling adjusts. The elevation of the towel is adjusted such that the towel is isolated from the flow of water in the shower space. The bath towel suspension apparatus comprises a first belt drive, a second belt drive, a towel rack, and a mounting structure. The mounting structure attaches to both the first belt drive and the second belt drive. The towel rack attaches to both the first belt drive and the second belt drive. The towel attaches to the towel rack. The mounting rack suspends the bath towel suspension apparatus from the shower ceiling. The bath towel suspension apparatus is manually operated.

These together with additional objects, features and advantages of the bath towel suspension apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the bath towel suspension apparatus in detail, it is to be understood that the bath towel suspension apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bath towel suspension apparatus.

It is therefore important that the claims be regarded as including such equivalent construction insofar as they do not depart from the spirit and scope of the bath towel suspension apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
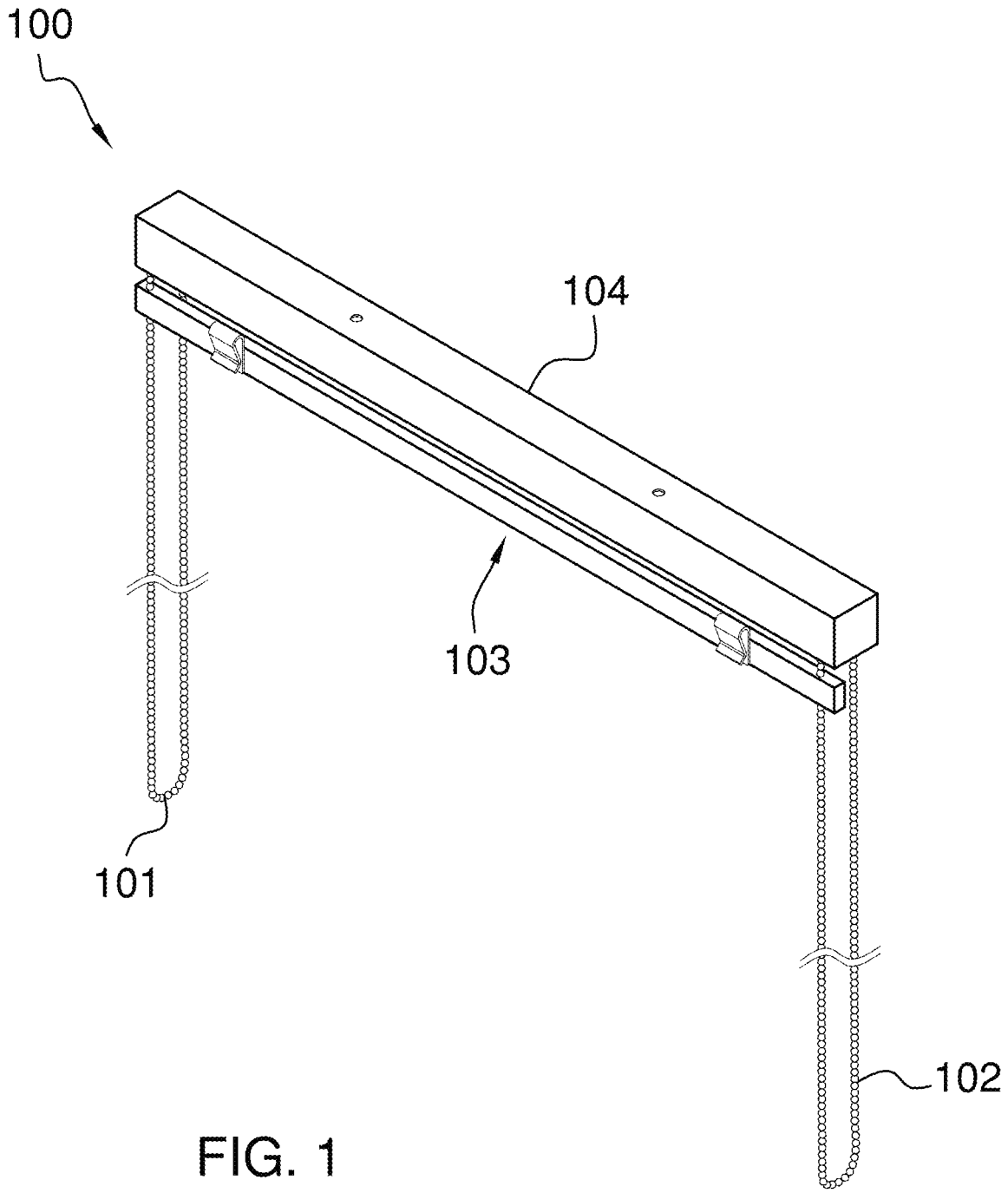
FIG. 1 is a perspective view of an embodiment of the disclosure.
Figure 2:
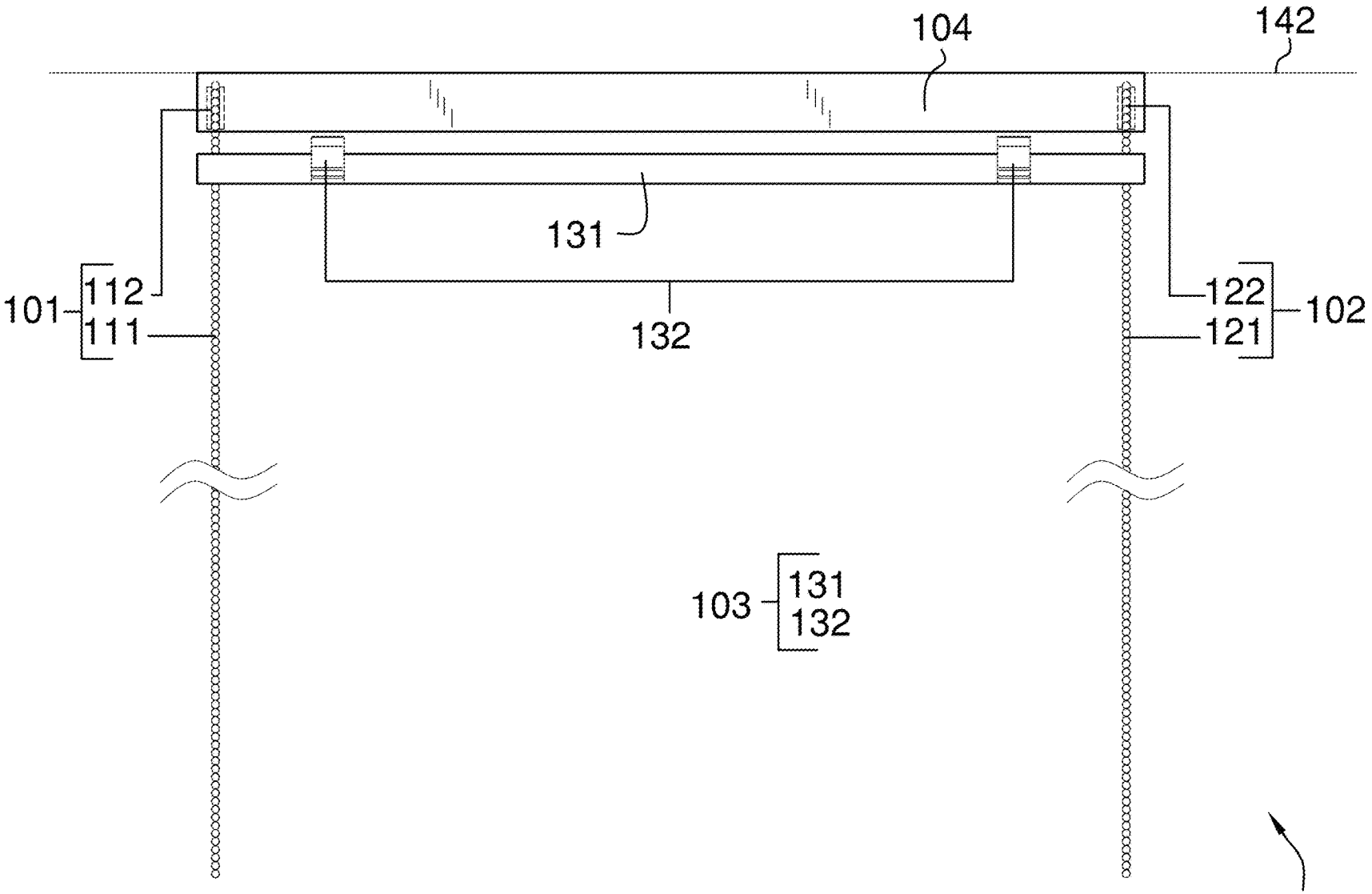
FIG. 2 is a front view of an embodiment of the disclosure.
Figure 3:
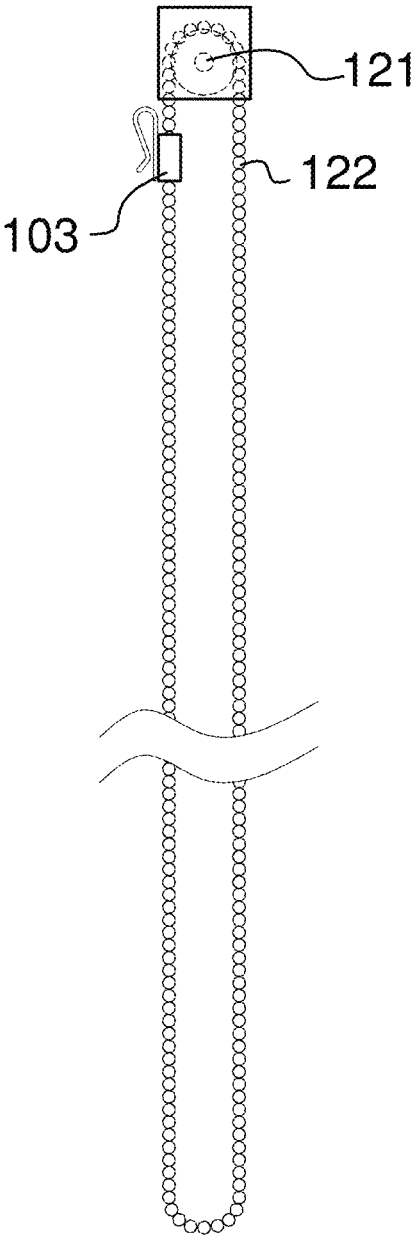
FIG. 3 is a side view of an embodiment of the disclosure.
Figure 4:
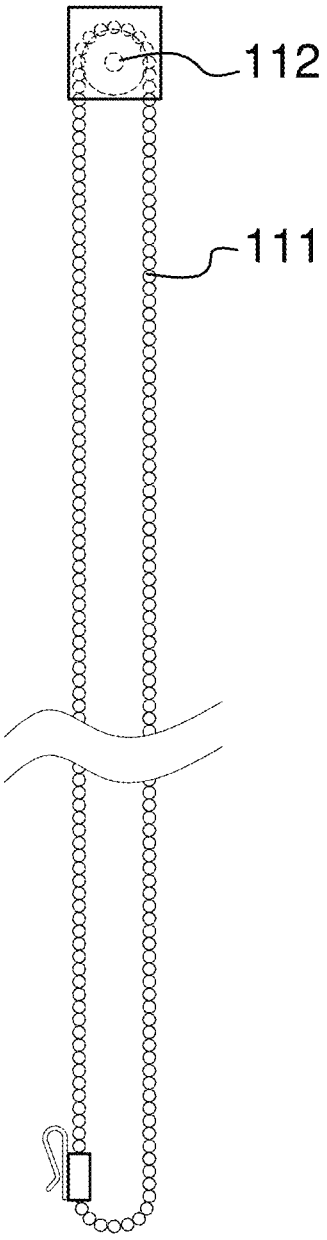
FIG. 4 is a reverse side view of an embodiment of the disclosure.
Figure 5:
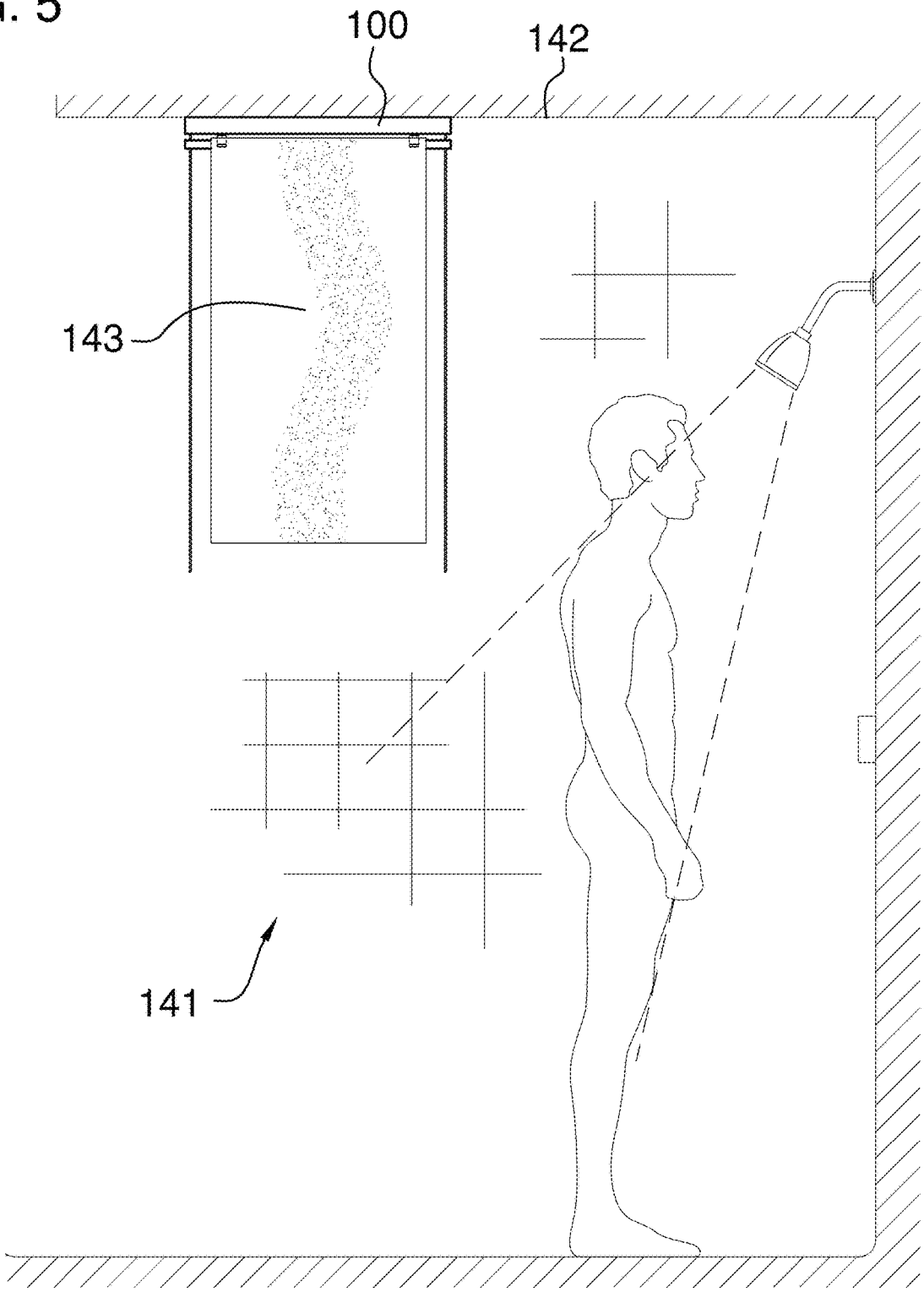
FIG. 5 is an in-use view of an embodiment of the disclosure.
Figure 6:
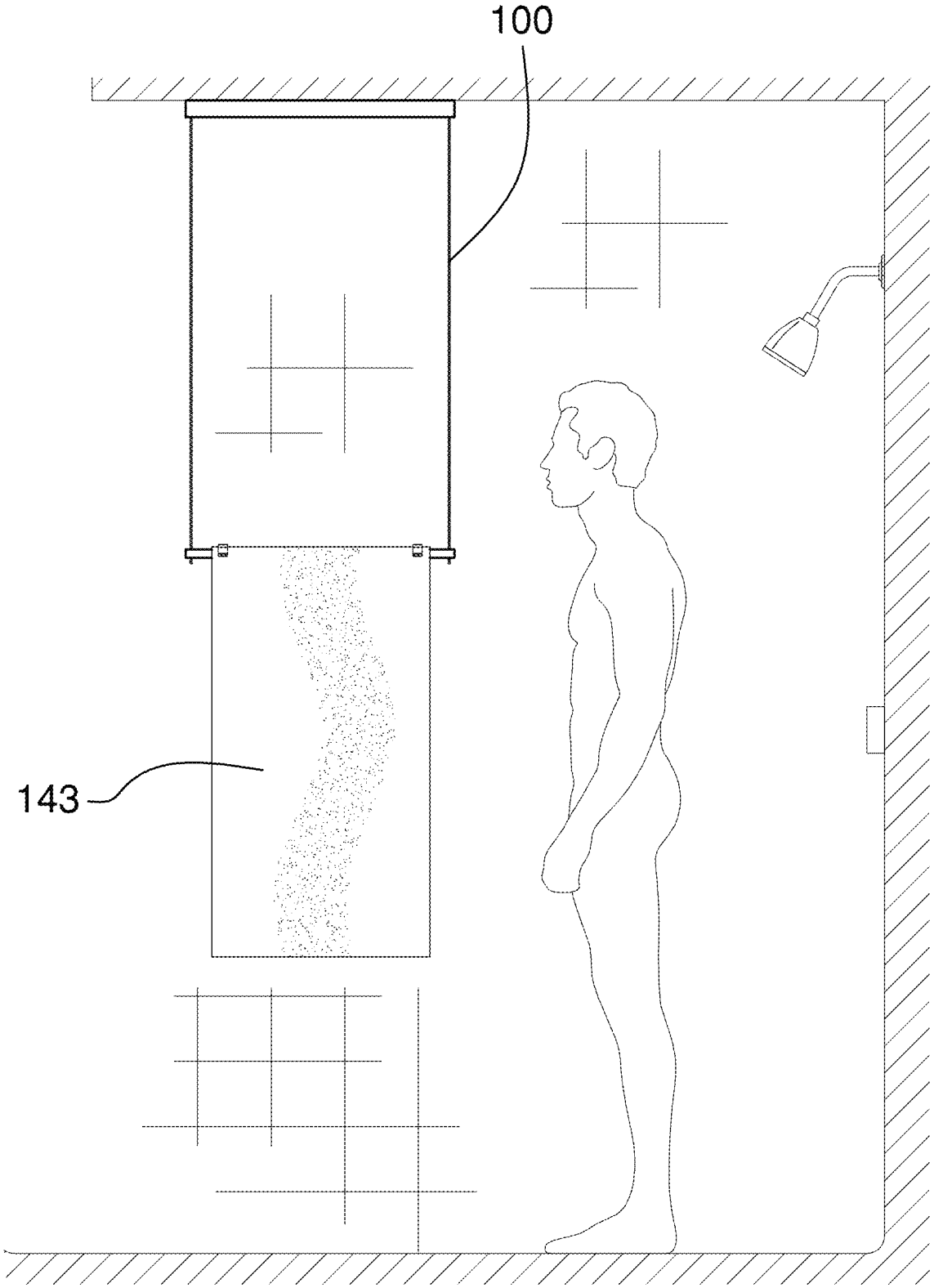
FIG. 6 is an in-use view of an embodiment of the disclosure.

Detailed reference will now be made to one or more potential embodiments of the disclosure, which are illustrated in FIGS. 1 through 6.

The bath towel suspension apparatus 100 (hereinafter invention) is a storage device. The towel 143 suspension apparatus is adapted for use in a shower space 141. The invention 100 mounts from the shower ceiling 142. The invention 100 is adapted for use with a towel 143. The invention 100 suspends the towel 143 from the shower ceiling 142. The invention 100 is an adjustable structure. By adjustable is meant that the invention 100 adjusts such that the elevation of the towel 143 relative to the shower ceiling 142 adjusts. The elevation of the towel 143 is adjusted such that the towel 143 is isolated from the flow of water in the shower space 141. The invention 100 comprises a first belt drive 101, a second belt drive 102, a towel 143 rack 103, and a mounting structure 104. The mounting structure 104 attaches to both the first belt drive 101 and the second belt drive 102. The towel 143 rack 103 attaches to both the first belt drive 101 and the second belt drive 102. The towel 143 attaches to the towel 143 rack 103. The mounting structure 104 suspends the invention 100 from the shower ceiling 142. The invention 100 is manually operated. The mounting structure 104 is a prism shaped structure.

The mounting structure 104 is a load bearing structure. The mounting structure 104 is a rigid structure. The mounting structure 104 permanently attaches to the shower ceiling 142 of the shower space 141. The mounting structure 104 attaches to the shower ceiling 142 such that the lateral face of the prism structure of the mounting structure 104 rests flush against the shower ceiling 142. The mounting structure 104 suspends the first belt drive 101, the second belt drive 102, the towel 143 rack 103, and the towel 143 above the supporting surface within the shower space 141. The mounting structure 104 forms the load path that transfers the loads of the first belt drive 101, the second belt drive 102, the towel 143 rack 103, and the towel 143 to the building that houses the shower space 141.

The first belt drive 101 is a belt drive. The belt drive is defined elsewhere in this disclosure. The first belt drive 101 attaches to the lateral face of the mounting structure 104. The mounting structure 104 suspends the first belt drive 101 from the shower ceiling 142. The towel 143 rack 103 attaches to the first belt drive 101. The first belt drive 101 suspends the towel 143 rack 103 from the mounting structure 104. The first belt drive 101 forms a load path that transfers a portion of the load of the towel 143 rack 103 to the mounting structure 104. The first belt drive 101 is a rotating structure. The elevation of the towel 143 rack 103 relative to the shower ceiling 142 adjusts by rotating the first belt drive 101. The first belt drive 101 comprises a first belt cord 111 and a first belt pulley 112.

The first belt cord 111 is a cord. The free ends of the cord structure of the first belt cord 111 are bound to each other to form a loop structure. The first belt cord 111 threads around the first belt pulley 112 such that the first belt cord 21 111 rotates around the first belt pulley 112. The first belt cord 111 attaches to the first belt pulley 112 such that a force applied to the first belt cord 111 in the direction parallel to the center axis of the first belt cord 111 will rotate the first belt cord 111 around the first belt pulley 112. The first belt cord 111 forms a load bearing structure. The first belt cord 111 forms a load path that transfers the load of the towel 143 rack 103 to the first belt pulley 112. The elevation of the towel 143 rack 103 relative to the shower ceiling 142 adjusts by rotating the first belt cord 111 around the first belt pulley 112.

The first belt pulley 112 is a pulley. The first belt pulley 112 permanently attaches to the lateral face of the prism structure of the mounting structure 104. The first belt pulley is suspended from the mounting structure 104. The first belt pulley 112 suspends the first belt cord 111 from the mounting structure 104. The first belt pulley 112 forms a load bearing structure. The first belt pulley 112 forms the load path that transfers the load carried by the first belt cord 111 to the mounting structure 104. The first belt pulley 112 is a rotating structure. The first belt pulley 112 allows the loop formed by the first belt cord 111 to rotate freely around the first belt pulley 112.

The second belt drive 102 is a belt drive. The belt drive is defined elsewhere in this disclosure. The second belt drive 102 attaches to the lateral face of the mounting structure 104. The mounting structure 104 suspends the second belt drive 102 from the shower ceiling 142. The towel 143 rack 103 attaches to the second belt drive 102. The second belt drive 102 suspends the towel 143 rack 103 from the mounting structure 104. The second belt drive 102 forms a load path that transfers the balance of the load of the towel 143 rack 103 to the mounting structure 104. The second belt drive 102 is a rotating structure. The elevation of the towel 143 rack 103 relative to the shower ceiling 142 adjusts by rotating the second belt drive 102. The second belt drive 102 comprises a second belt cord 121 and a second belt pulley 122.

The second belt cord 121 is a cord. The free ends of the cord structure of the second belt cord 121 are bound to each other to form a loop structure. The second belt cord 121 threads around the second belt pulley 122 such that the second belt cord 121 rotates around the second belt pulley 122. The second belt cord 121 attaches to the second belt pulley 122 such that a force applied to the second belt cord 121 in the direction parallel to the center axis of the second belt cord will rotate the second belt cord 121 around the second belt pulley 122. The second belt cord 121 forms a load bearing structure. The second belt cord 121 forms a load path that transfers the load of the towel 143 rack 103 to the second belt pulley 122. The elevation of the towel 143 rack 103 relative to the shower ceiling 142 adjusts by rotating the second belt cord 121 around the second belt pulley 122.

The second belt pulley 122 is a pulley. The second belt pulley 122 permanently attaches to the lateral face of the prism structure of the mounting structure 104. The second belt pulley 122 is suspended from the mounting structure 104. The second belt pulley 122 suspends the second belt cord 121 from the mounting structure 104. The second belt pulley 122 forms a load bearing structure. The second belt pulley 122 forms the load path that transfers the load carried by the second belt cord 121 to the mounting structure 104. The second belt pulley 122 is a rotating structure. The second belt pulley 122 allows the loop formed by the second belt cord 121 to rotate freely around the second belt pulley 122.

The towel 143 rack 103 permanently attaches to the first belt drive 101 and the second belt drive 102. The elevation of the towel 143 rack 103 is adjusted when the first belt drive 101 and the second belt drive 102 are simultaneously rotated.

The towel 143 rack 103 has the primary shape of a prism. The towel 143 rack 103 is a load bearing structure. The towel 143 rack 103 is a prism shaped structure. The towel 143 rack 103 permanently attaches to both the first belt drive 101 and the second belt drive 102. The towel 143 rack 103 attaches to the first belt drive 101 and the second belt drive 102 such that the center axis of the towel 143 rack 103 is horizontally oriented. The towel 143 rack 103 attaches to the first belt drive 101 and the second belt drive 102 such that the elevation of the towel 143 rack 103 relative to the shower ceiling 142 adjusts by rotating the first belt drive 101 and the second belt drive 102. The towel 143 rack 103 forms the structure of the invention 100 that suspends the towel 143 from the first belt drive 101 and the second belt drive 102. The towel 143 is stored on the towel 143 rack 103. The towel 143 rack 103 comprises a towel 143 bar 131 and a towel 143 clip device 132.

The towel 143 bar 131 is a prism shaped structure. The towel 143 bar 131 is a load bearing structure. The towel 143 bar 131 is a rigid structure. The towel 143 bar 131 permanently attaches to the first belt cord 111 of the first belt drive 101. The towel 143 bar 131 permanently attaches to the second belt cord 121 of the second belt drive 102. The towel 143 bar 131 attaches to the first belt drive 101 and the second belt drive 102 such that the center axis of the prism structure of the towel 143 bar 131 is horizontally oriented. The towel 143 bar forms the load path that transfers the load of the towel 143 to the first belt drive 101 and the second belt drive 102. The elevation of the towel 143 rack 103 relative to the shower ceiling 142 is measured from the center axis of the towel 143 bar 131.

The towel 143 clip device 132 is a fastening device. The towel 143 clip device 132 forms the structure of the towel 143 rack 103 that secures the towel 143 to the towel 143 bar 131. The towel 143 clip device 132 removably attaches the towel 143 to the towel 143 bar 131. The towel 143 clip device 132 attaches to the lateral face of the towel 143 bar 131.

the Following Definitions were Used in this Disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Associate: As used in this disclosure, the term associate is used to describe a relationship between a first object and a second object. The use of the term associated implies both: a) that the first object works with the second object in order to accomplish a task necessary for the implementation of the invention (such as joining two objects together); and, b) the relationship remains stable through the accomplishment of the task. By stable is meant that neither the first object or the second object are intended to be interchanged with a third object during the use of the invention.

Barrier: As used in this disclosure, a barrier is a physical obstacle that forms a boundary between a first space and a second space. The barrier prevents the passage of an object between the first space and the second space.

Belt: As used in this disclosure, a belt is a strip of flexible material that is wraps around the lateral face of a prism-shaped object.

Belt Drive: As used in this disclosure, the belt drive is a transmission. The belt drive comprises a belt (or cord), a drive pulley, one or more transfer pulleys, and a drive mechanism. The belt is threaded around that drive pulley and the one or more transfer pulleys to form a loop. The drive mechanism attaches to the drive pulley such that the rotation of the drive mechanism rotates the belt around the one or more transfer pulleys. The rotation of the belt around the one or more transfer pulleys transfers the rotational energy from the drive mechanism to the one or more transfer pulleys such that each of the one or more transfer pulleys can rotate a load attached to the transfer pulley. A transfer pulley that changes the direction of the track but does not rotate a load is called an idler pulley. A chain drive is a belt drive wherein: a) the belt is replaced by a chain; and each of the drive pulley; and, b) each of the one or more transfer pulleys is a gear structure.

Cant: As used in this disclosure, a cant is an angular deviation from one or more reference lines (or planes) such as a vertical line (or plane) or a horizontal line (or plane).

Ceiling: As used in this disclosure a ceiling refers to either: 1) the superior horizontal surface of a chamber that is distal from the floor; 2) the superior horizontal surface of a structure; or, 3) the upper limit of a range. A floor and a ceiling can refer to the same structure wherein the selection depends solely on the point of view of the user. The selection of this definition depends on the context. In situations where the context is unclear the first definition should be used. A drop ceiling is a secondary ceiling that is suspended from a primary ceiling such that a space exists between the primary ceiling and the secondary ceiling. The drop ceiling is used to form a protected space that hides utility structures such as pipes, ducts, and cables.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord. This definition further includes textile webbings as a type of cord. The free end of a cord refers to the region of the cord that is proximal to the congruent end of the prism shape of the cord. A fixed end of a cord refers to a free end of a cord that has been bound to an anchor point.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; 6 and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Mount: As used in this disclosure, a mount is a mechanical structure that attaches or incorporates an object into a load path.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Perimeter: As used in this disclosure, a perimeter is one or more curved or straight lines that bounds an enclosed area on a plane or surface. The perimeter of a circle is commonly referred to as a circumference.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Private: As used in this disclosure, the term private refers to the limitation of use of an object to one or more individuals. The term privacy refers to maintaining an object or individual in a location where the object or individual can be neither observed nor disturbed.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Pulley: As used in this disclosure a pulley is a wheel with a grooved rim around which a cord (or other form of rope, line, or cable) passes. The pulley is used to change the direction of a force applied to the cord.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Shower: As used in this disclosure, a shower is a mechanical structure that generates a spray of water used by a client for cleaning. The shower is typically maintained in an enclosed space that provides privacy. A community shower refers to one or more showers that do not provide for the privacy of the client.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Textile: As used in this disclosure, a textile is a material that is woven, knitted, braided or felted. Synonyms in common usage for this definition include fabric and cloth. The two surfaces of the textile with the greatest surface area are called the faces of the textile.

Towel: As used in this disclosure, a towel refers to an absorbent sheeting material that is used to remove liquid from an object. A towel formed from an absorbent paper sheeting is called a paper towel.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIG. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A bath towel suspension apparatus comprising a first belt drive, a second belt drive, a towel rack, and a mounting structure;

wherein the mounting structure attaches to both the first belt drive and the second belt drive;

wherein the towel rack attaches to both the first belt drive and the second belt drive;

wherein the towel suspension apparatus is adapted for use in a shower space, and from a shower ceiling;

wherein the bath towel suspension apparatus is adapted for use with a towel such that the bath towel suspension apparatus suspends the towel from the shower ceiling;

wherein the bath towel suspension apparatus is an adjustable structure such that the bath towel suspension apparatus is adapted to adjust an elevation of the towel relative to the shower ceiling adjusts;

wherein the towel attaches to the towel rack;

wherein the mounting structure suspends the bath towel suspension apparatus from the shower ceiling;

wherein the mounting structure permanently attaches to the shower ceiling of the shower space;

wherein the mounting structure attaches to the shower ceiling such that a lateral face of the mounting structure rests flush against the shower ceiling;

wherein the mounting structure suspends the first belt drive, the second belt drive, the towel rack, and the towel above a floor surface within the shower space;

wherein the mounting structure forms a load path that transfers loads of the first belt drive, the second belt drive, the towel rack, and the towel to a building that houses the shower space.

2. The bath towel suspension apparatus according to claim 1 wherein the first belt drive is a belt drive;

wherein the first belt drive attaches to the lateral face of the mounting structure;

wherein the mounting structure suspends the first belt drive from the shower ceiling;

wherein the towel rack attaches to the first belt drive;

wherein the first belt drive suspends the towel rack from the mounting structure;

wherein the first belt drive forms a load path that transfers a portion of the load of the towel rack to the mounting structure;

wherein the first belt drive is a rotating structure;

wherein the elevation of the towel rack relative to the shower ceiling adjusts by rotating the first belt drive.

3. The bath towel suspension apparatus according to claim 2 wherein the second belt drive is a belt drive;

wherein the second belt drive attaches to the lateral face of the mounting structure;

wherein the mounting structure suspends the second belt drive from the shower ceiling;

wherein the towel rack attaches to the second belt drive;

wherein the second belt drive suspends the towel rack from the mounting structure;

wherein the second belt drive forms a load path that transfers the balance of the load of the towel rack to the mounting structure;

wherein the second belt drive is a rotating structure;

wherein the elevation of the towel rack relative to the shower ceiling adjusts by rotating the second belt drive.

4. The bath towel suspension apparatus according to claim 3 wherein the towel rack is a load bearing structure;

wherein the towel rack permanently attaches to both the first belt drive and the second belt drive;

wherein the towel rack attaches to the first belt drive and the second belt drive such that the center axis of the towel rack is horizontally oriented;

wherein the towel rack attaches to the first belt drive and the second belt drive such that the elevation of the towel rack relative to the shower ceiling adjusts by rotating the first belt drive and the second belt drive;

wherein the towel rack forms the structure of the bath towel suspension apparatus that suspends the towel from the first belt drive and the second belt drive.

5. The bath towel suspension apparatus according to claim 4 wherein the first belt drive comprises a first belt cord and a first belt pulley;

wherein the first belt cord is a cord;

wherein the free ends of the cord structure of the first belt cord are bound to each other to form a loop structure;

wherein the first belt cord threads around the first belt pulley such that the first belt cord rotates around the first belt pulley;

wherein the first belt cord attaches to the first belt pulley such that a force applied to the first belt cord in the direction parallel to the center axis of the first belt cord will rotate the first belt cord around the first belt pulley;

wherein the first belt cord forms a load bearing structure;

wherein the first belt cord forms a load path that transfers the load of the towel rack to the first belt pulley;

wherein the elevation of the towel rack relative to the shower ceiling adjusts by rotating the first belt cord around the first belt pulley;

wherein the first belt pulley is a pulley;

wherein the first belt pulley permanently attaches to the lateral face of the mounting structure;

wherein the first belt pulley is suspended from the mounting structure;

wherein the first belt pulley suspends the first belt cord from the mounting structure;

wherein the first belt pulley forms a load bearing structure;

wherein the first belt pulley forms the load path that transfers the load carried by the first belt cord to the mounting structure;

wherein the first belt pulley is a rotating structure.

6. The bath towel suspension apparatus according to claim 5 wherein the second belt drive comprises a second belt cord and a second belt pulley;

wherein the second belt cord is a cord;

wherein the free ends of the cord structure of the second belt cord are bound to each other to form a loop structure;

wherein the second belt cord threads around the second belt pulley such that the second belt cord rotates around the second belt pulley;

wherein the second belt cord attaches to the second belt pulley such that a force applied to the second belt cord in the direction parallel to the center axis of the second belt cord will rotate the second belt cord around the second belt pulley;

wherein the second belt cord forms a load bearing structure;

wherein the second belt cord forms a load path that transfers the load of the towel rack to the second belt pulley;

wherein the elevation of the towel rack relative to the shower ceiling adjusts by rotating the second belt cord around the second belt pulley;

wherein the second belt pulley is a pulley;

wherein the second belt pulley permanently attaches to the lateral face of the mounting structure;

wherein the second belt pulley is suspended from the mounting structure;

wherein the second belt pulley suspends the second belt cord from the mounting structure;

wherein the second belt pulley forms a load bearing structure;

wherein the second belt pulley forms the load path that transfers the load carried by the second belt cord to the mounting structure;

wherein the second belt pulley is a rotating structure.

7. The bath towel suspension apparatus according to claim 6 wherein the towel rack permanently attaches to the first belt drive and the second belt drive;

wherein the elevation of the towel rack is adjusted when the first belt drive and the second belt drive are simultaneously rotated.

8. The bath towel suspension apparatus according to claim 7 wherein the towel rack comprises a towel bar and a towel clip device;

wherein the towel bar is a load bearing structure;

wherein the towel bar is a rigid structure;

wherein the towel bar permanently attaches to the first belt cord of the first belt drive;

wherein the towel bar permanently attaches to the second belt cord of the second belt drive;

wherein the towel bar attaches to the first belt drive and the second belt drive such that the center axis of the towel bar is horizontally oriented;

wherein the towel bar forms the load path that transfers the load of the towel to the first belt drive and the second belt drive;

wherein the elevation of the towel rack relative to the shower ceiling is measured from the center axis of the towel bar;

wherein the towel clip device is a fastening device;

wherein the towel clip device forms the structure of the towel rack that secures the towel to the towel bar;

wherein the towel clip device removably attaches the towel to the towel bar;

wherein the towel clip device attaches to the lateral face of the towel bar.

* * * * *